US005179930A

United States Patent [19]

Simo

[11] Patent Number: 5,179,930

[45] Date of Patent: Jan. 19, 1993

[54] ARROW REST WITH FORWARD AND BACKWARD DEFLECTABLE ARROW SUPPORT ARM

[76] Inventor: Miroslav A. Simo, 370 N. Delaplaine Rd., Riverside, Ill. 60546

[21] Appl. No.: 710,032

[22] Filed: May 31, 1991

Related U.S. Application Data

[63] Continuation-in-part of Ser. No. 693,776, Apr. 26, 1991, Pat. No. 5,148,796, which is a continuation of Ser. No. 418,190, Oct. 6, 1989, abandoned, which is a continuation-in-part of Ser. No. 170,161, Mar. 18, 1988, Pat. No. 4,881,515, which is a continuation-in-part of Ser. No. 57,383, Jun. 2, 1987, Pat. No. 4,809,670, which is a continuation-in-part of Ser. No. 788,486, Oct. 17, 1985, Pat. No. 4,732,135, which is a continuation-in-part of Ser. No. 482,186, Apr. 5, 1983, Pat. No. 4,548,188.

[51] Int. Cl.[5] ..... F41B 5/00

[52] U.S. Cl. ..... 124/44.5; 124/24.1

[58] Field of Search ..... 124/24.1, 44.5

[56] References Cited

U.S. PATENT DOCUMENTS

| | | | |
|---|---|---|---|
| 3,108,584 | 10/1963 | Coe | 124/24.1 |
| 3,769 956 | 11/1973 | Simo | 124/24.1 X |
| 3,828,757 | 8/1974 | Finlay | 124/24.1 X |
| 4,170,980 | 10/1979 | Killian | 124/44.5 |
| 4,278,066 | 7/1981 | Zinz, Sr. | 124/24.1 X |
| 4,489,704 | 12/1984 | Troncoso, Jr. | 124/44.5 X |
| 4,715,355 | 12/1987 | Lattig | 124/44.5 |
| 4,898,145 | 2/1990 | Simo | 124/44.5 |

FOREIGN PATENT DOCUMENTS

| | | | |
|---|---|---|---|
| 3424744 | 1/1986 | Fed. Rep. of Germany | 124/44.5 |

*Primary Examiner*—Randolph A. Reese
*Assistant Examiner*—Jeffrey L. Thompson
*Attorney, Agent, or Firm*—Speckman & Pauley

[57] ABSTRACT

An arrow rest having an arrow support arm with a riser portion and a support portion. The riser portion is rotatably mounted with respect to a housing. A return spring is mounted with respect to the arrow support arm so as to urge the support portion of the arrow support arm into a rest position. The support portion has limited movement in a forward direction from a rest position to a deflected position. The support portion is allowed to deflect in a backward direction, beyond the rest position. After backward deflection, the support portion can be reset to the original rest position.

13 Claims, 5 Drawing Sheets

ARROW REST WITH FORWARD AND BACKWARD DEFLECTABLE ARROW SUPPORT ARM

CROSS-REFERENCE TO RELATED APPLICATIONS

This application is a continuation-in-part of my earlier filed application, Ser. No. 693,776, filed Apr. 26, 1991, now U.S. Pat. No. 5,148,796, which is a continuation of my earlier filed application, Ser. No. 418,190, filed Oct. 6, 1989, now abandoned, which is a continuation-in-part of my earlier filed application, Ser. No. 170,161, filed Mar. 18, 1988, now U.S. Pat. No. 4,881,515, which is a continuation-in-part of my earlier filed application, Ser. No. 057,383, filed Jun. 2, 1987, now U.S. Pat. No. 4,809,670, which is a continuation-in-part of my earlier filed application, Ser. No. 788,486, filed Oct. 17, 1985, now U.S. Pat. No. 4,732,135, which is a continuation-in-part of my earlier filed application, Ser. No. 482,186, filed Apr. 5, 1983, now U.S. Pat. No. 4,548,188.

BACKGROUND OF THE INVENTION

1. Field of the Invention

This invention relates to an arrow rest for an archery bow, and more particularly to an arrow rest which has a support arm that can be deflected forward and backward and then be reset to its original rest position.

2. Description of the Prior Art

An arrow rest is usually secured to the handle area of an archery bow, and often includes a rigid notch or ledge which supports and guides an arrow as it is discharged from the bow. However, rigid arrow rests may introduce undesirable vertical and horizontal force components upon the arrow when the shaft and fletching pass over the arrow rest, causing undesired deflection of the arrow and damage to the fletching.

Flexible arrow rests which deflect both vertically and horizontally by spring action when the arrow passes over the arrow rest decrease such undesired deflection, as described in U.S. Pat. Nos. 4,074,674, 3,871,352 and 3,935,854. Spring biased arrow rests deflecting in a generally horizontal plane are described in U.S. Pat. Nos. 3,769,956 and 3,828,757. Also, arrow rests may be mechanically deflected away from the arrow when the arrow is discharged, as described in U.S. Pat. No. 3,504,659.

An arrow may travel laterally with respect to the bow if the arrow rest is not properly aligned on the handle. Prior arrow rests which may be laterally adjusted require the use of tools or they are rigid rests, as described in U.S. Pat. Nos. 3,285,237, 3,871,352, 3,232,286 and 3,757,764. A spring-biased plunger for lateral placement of an arrow on a fixed rest is described in U.S. Pat. No. 3,482,563.

U.S. Pat. No. 4,898,145 discloses a retractable arrow rest having an arrow support wire mounted in a bearing hole that is angled forwardly and upwardly so that an outwardly extending portion of the arrow support wire moves forwardly and downwardly to clear an arrow shaft and fletching. Although the arrow support wire is designed to deflect forward upon discharge of an arrow and then automatically return to its original rest position, the arrow support wire is not designed to deflect backward.

Prior arrow rests have been secured to the bow handle area with adhesive, screws, or the like, and when replacement of the arrow rest is necessary due to breakage or wear, there is no assurance that the new arrow rest, even if of the same style as the old arrow rest, will be properly positioned for shooting without essentially complete realignment to maintain a consistent sight and nocking point.

SUMMARY OF THE INVENTION

It is one object of this invention to provide an arrow rest having an arrow support arm that can be deflected both in a forward and backward direction, and when deflected backward beyond the normal rest position of the arrow support arm, the arrow support arm can be reset to its original rest position.

It is another object of this invention to provide an arrow rest that can be quickly disconnected, particularly without a need for tools, from an archery bow and then instantly replaced in a precise and consistent position with respect to the bow.

It is another object of this invention to provide an arrow rest that once set in a predetermined position does not rotate in a plane parallel to the plane of the bow handle-riser portion.

It is another object of this invention to provide an arrow rest having a first adapter secured to the arrow rest and a second adapter secured with respect to a bow handle-riser portion of an archery bow, wherein the first and second adapters are non-rotatably mateable with each other.

It is another object of this invention to provide an arrow rest having an arrow support arm which may be deflected by movement of an arrow shaft and fletching of an arrow wherein the arrow support arm automatically returns to its initial rest position after discharge of the arrow.

Still another object of this invention is to provide an arrow rest which may be quickly and easily laterally adjusted in the field without requiring tools to accomplish such lateral adjustment.

Yet another object of this invention is to provide an arrow rest having a lateral or horizontal depression and return "plunger" action caused by an arrow shaft upon discharge of the arrow.

The above and further objects of this invention are accomplished with an arrow rest having a housing to which either a male or female adapter is connected. An arrow support arm has a riser portion and a support portion. The riser portion is rotatably mounted with respect to the housing. The riser portion of the arrow support arm is preferably mounted within a through bore of a bushing which is secured to the housing. In such embodiment, the riser portion is preferably mounted so that it has limited vertical movement. A return spring is mounted with respect to the arrow support arm so that the return spring urges the support portion into a rest position. An arrow shaft is loaded onto the arrow rest when the support arm is in the rest position.

The support portion of the arrow support arm has limited vertical movement. As the arrow is discharged, the support portion moves in a forward direction from the rest position to a deflected position. In one preferred embodiment according to this invention, the movement of the support portion is limited between the rest position and the deflected position with a spring clip or leaf spring that is secured to the housing. According to one preferred embodiment of this invention, a free end portion of the riser portion is bent at an angle with respect to the riser portion. The free end portion preferably contacts a housing wall when the support portion is in the deflected position and contacts a detent of the spring clip or leaf spring when in the rest position.

The spring clip or leaf spring is preferably secured with respect to the housing. In on preferred embodiment according to this invention, the housing forms a groove in which the spring clip or leaf spring is mounted, with an interference fit.

According to one preferred design of the spring clip or leaf spring and the arrow support arm, the support portion is able to deflect both in a forward direction, from the rest position to the deflected position, and in a backward direction, beyond the rest position of normal movement of the support portion. With such design, the support portion can be reset to the original rest position, particularly after such backward movement.

A cover is preferably secured to the housing so that the mechanical elements providing movement of the arrow support arm are not exposed. In another preferred embodiment according to this invention, the cover comprises a horizontal or lateral cushion for allowing a discharged arrow to force a contact portion of the housing in a horizontal or lateral direction, with respect to a vertically positioned archery bow. The contact portion is preferably spaced at a distance from an outer wall of the housing. The contact portion is hingedly mounted to the housing and the contact portion is urged or biased into a shooting position. The housing and the cover are each injection molded with a polymeric material, according to yet another preferred embodiment of this invention.

The above and other objects of this invention are further accomplished with a quick disconnection between the arrow rest and the bow handle-riser portion of an archery bow which includes first connecting means fixed with respect to the bow handle-riser portion and second connecting means secured to the arrow rest. The first connecting means are non-rotatably mateable with the second connecting means. In a mounted position of the arrow rest with respect to the bow handle-riser portion, the first connecting means are secured to the second connecting means thereby locking the arrow rest in a fixed position. The first connecting means can be repeatedly positioned and instantly replaced in a precise and consistent position with respect to the bow. It is a very important aspect of this invention to have an arrow rest that can be instantly replaced in a precise and consistent position since a 1° to 2° misalignment of the arrow rest results in an error of about 2½ to 5 feet at a target positioned 50 yards from the bow.

BRIEF DESCRIPTION OF THE DRAWINGS

The above mentioned and other features of this invention and the manner of obtaining them will become more apparent, and the invention itself will be best understood by reference to the following description of specific embodiments of the invention taken in conjunction with the accompanying drawings, in which.

DESCRIPTION OF THE PREFERRED EMBODIMENTS

Figure 1:
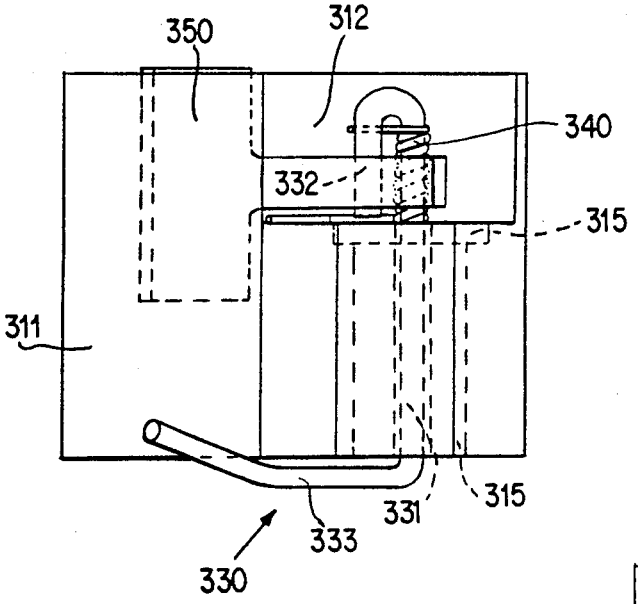
FIG. 1 is a front view of an arrow rest biased into a normal rest position, according to one preferred embodiment of this invention.
Figure 2:
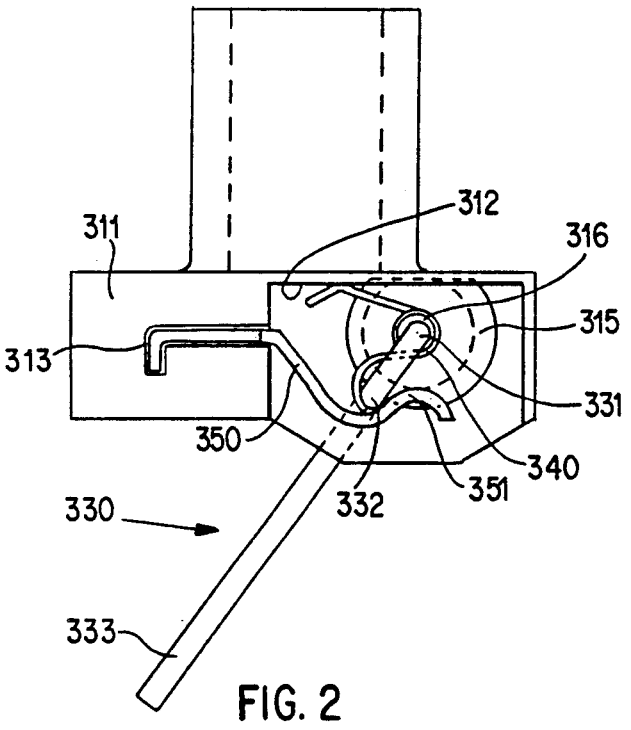
FIG. 2 is a top view of the arrow rest, as shown in FIG. 1.

FIGS. 1-9 illustrate an arrow rest according to one preferred embodiment of this invention. As shown in FIGS. 1 and 2, the arrow rest comprises housing 311 which has housing wall 312 and which defines groove 313. Bushing 315 is secured to housing 311. As shown in FIG. 1., bushing 315 has an upper shoulder and is molded into the preferably plastic material of housing 311. However, it is apparent that bushing 315 can be secured with respect to housing 311 in any other suitable manner. Bushing 315 has through bore 316.

Figure 5:
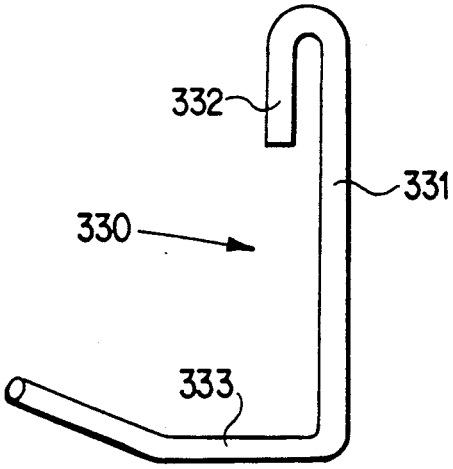
FIG. 5 is a front view of an arrow support arm, according to one preferred embodiment of this invention.
Figure 7:
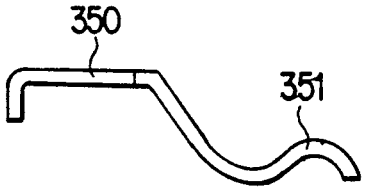
FIG. 7 is a top view of the spring clip or leaf spring, as shown in FIG. 6.
Figure 6:
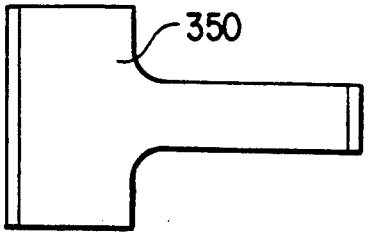
FIG. 6 is a front view of a spring clip or leaf spring according to one preferred embodiment of this invention.
Figure 8:
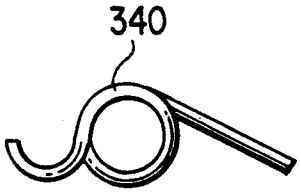
FIG. 8 is a front view of a return coil spring, according to one preferred embodiment of this invention.
Figure 9:
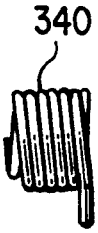
FIG. 9 is a side view of the return coil spring, as shown in FIG. 8.

As shown in FIG. 5, arrow support arm 330 has riser portion 331 and support portion 333. According to one preferred embodiment of this invention, free end portion 332 of support portion 333 is bent or formed at an angle with respect to riser portion 331. As shown in the drawings and later discussed, such bent free end portion 332 acts as a cam surface which contacts either housing wall 312 or spring clip or leaf spring 350 so that support portion 333 has limited normal movement between a rest position and a deflected position of arrow support arm 330.

Riser portion 331 is rotatably mounted with respect to housing 311. In one preferred embodiment according to this invention, riser portion 331 is mounted within the through bore 316 of bushing 315. Riser portion 331 preferably has limited vertical movement when mounted within bushing 315. Such limited vertical movement can be accomplished by a combination of the bent free end portion 332 contacting housing 311 and a lower bend in the wire of arrow support arm 330, as shown in FIG. 1. It is apparent that such limited vertical movement can be accomplished with specific shoulder arrangements or by any other suitable vertical movement limiting means apparent to those persons skilled in the art.

Return spring 340 is mounted with respect to arrow support arm 330 so that it urges or biases support portion 333 into the normal rest position. In such rest position, an arrow shaft is loaded onto support portion 333 of the arrow rest. According to one preferred embodiment of this invention, return spring 340 is a coil spring mounted around riser portion 331, as shown in FIGS. 1 and 2. When shaped as a coil, return spring 340 comprises two opposing spring feet. One spring foot is attached to free end portion 332 while the opposite spring foot abuts housing wall 312, according to the preferred embodiment as shown in FIGS. 1 and 2. It is apparent that the spring feet can be attached to other suitable elements of this invention and, thus, accomplish the same result of urging support portion 333 into the rest position. Thus, when an arrow is discharged and passes in a forward axial direction, support portion 333 moves in a forward direction from the rest position to the deflected position. After the forces from the discharged arrow are relieved, return spring 340 urges support portion 333 back into the rest position.

Referring now to an important aspect of this invention, the arrow rest further comprises release means for allowing support portion 333 to deflect in a backward direction, with respect to the above described forward direction, beyond the rest position of the normal movement. After forced backward beyond the rest position, such release means also allows the support portion to be reset back to the rest position. Such particular aspect of this invention is important, for example, when carrying an archery bow and arrow support arm 330 accidentally catches an obstruction, such as a tree limb or any other field obstruction. With the backward deflecting aspect of this invention, in such situation, arrow support arm 330 will deflect backward without bending or otherwise damaging any portion of arrow support arm 330. When arrow support arm 330 moves in a backward direction beyond the rest position, it can be reset by simply moving arrow support 330 in a forward direction with enough force to overcome a resisting bias force applied by spring clip or leaf spring 350.

According to one preferred embodiment, the backward deflecting aspect of this invention is accomplished with spring clip or leaf spring 350 being secured with respect to housing 311. As shown in FIG. 2, spring clip or leaf spring 350 forms detent portion 351. Bent free end portion 332 acts as a cam surface with respect to detent portion 351. As riser portion 331 rotates within through bore 316 of bushing 315, free end portion 332 contacts detent portion 351. Continued rotation of riser portion 331 urges spring clip or leaf spring 350 into a deflected position so that riser portion 331 can continue to rotate backward allowing support portion 333 to move beyond the rest position. It is apparent that spring clip or leaf spring 350 can have any other suitable shape. Depending upon the particular arrangement of spring clip or leaf spring 350, it is apparent that spring clip or leaf spring 350 can be replaced by other spring means.

Spring clip or leaf spring 350 is preferably secured with respect to housing 311 by a forced fitting of spring clip or leaf spring 350 within groove 313. However, it is apparent that spring clip or leaf spring 350 can be secured with respect to housing 311 in any other suitable manner. However spring clip or leaf spring 350 is secured, it is important to note that in a rest position, detent portion 351 should remain fixed with respect to housing 311.

Figure 3:
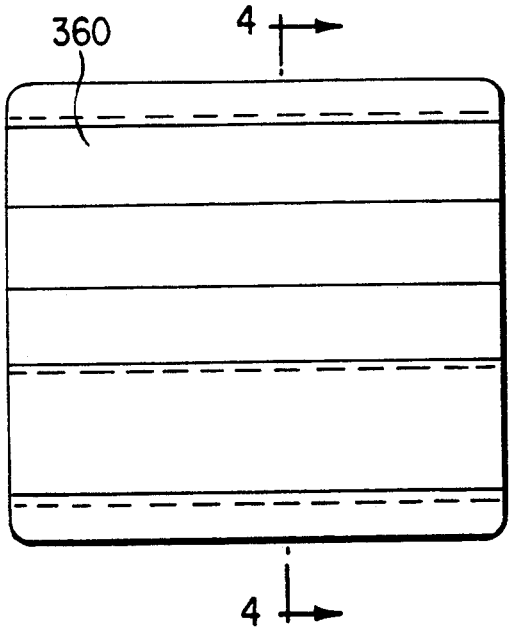
FIG. 3 is a front view of a cover according to one preferred embodiment of this invention.
Figure 4:
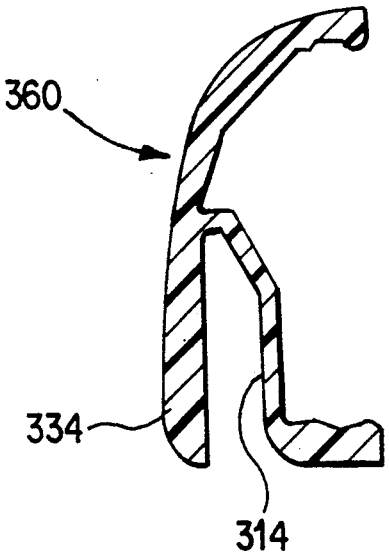
FIG. 4 is a cross-sectional view taken along line 4—4, as shown in FIG. 3.

In another preferred embodiment according to this invention, it is advantageous to enclose the above described elements which allow arrow support arm 330 to deflect both in a forward and backward direction. FIGS. 3 and 4 show one preferred embodiment of cover 360 which can be secured to housing 311 in any suitable manner known to those persons skilled in the art. Cover 360 preferably comprises horizontal cushion means for allowing a discharged arrow to force contact portion 334 of cover 360 in a horizontal direction, with respect to a vertically positioned archery bow. In one preferred embodiment according to this invention, the horizontal cushion means comprises contact portion 334 spaced at a distance from outer wall 314 of housing 311. Such cantilever arrangement allows contact portion 334 to deflect when horizontal component forces act upon contact portion 334, from the discharged arrow. With cover 360 injection molded to form an integral piece with housing 311 the resiliency of the integral piece urges or biases contact portion 334 into a normal shooting or rest position. Thus, after contact portion 334 is deflected, it is urged back into the normal shooting or rest position. However, it is apparent that contact portion 334 can also form a hinge connection with respect to housing 311 by other suitable mechanical means familiar to those persons skilled in the art.

U.S. Pat. Nos. 4,548,188, 4,732,135, 4,809,670 and 4,881,515 more fully teach embodiments of the invention shown in FIGS. 11–18. These patents in their entirety are incorporated herein by reference. In these embodiments, the arrow support means may have a conventional retractable arrow support wire 90 rotatably mounted on or secured to flat plate 91. These patents teach flat plate 91 of the arrow rest removably, rigidly attached to one side of mating mounting plate 80. The other side of mating mounting plate 80 has fitting means 81 which snugly fits over the end of mounting means 20 and ma be maintained firmly in position by a screw into the end of mounting means 20. It is apparent that fitting means 81 can have a "D" cross-sectional shape, as shown in FIG. 11, a double "D" cross-sectional shape as shown in FIG. 12, or any other cross-sectional shape that prevents rotation of mounting plate 80 with respect to handle-riser portion 10.

Figure 10:
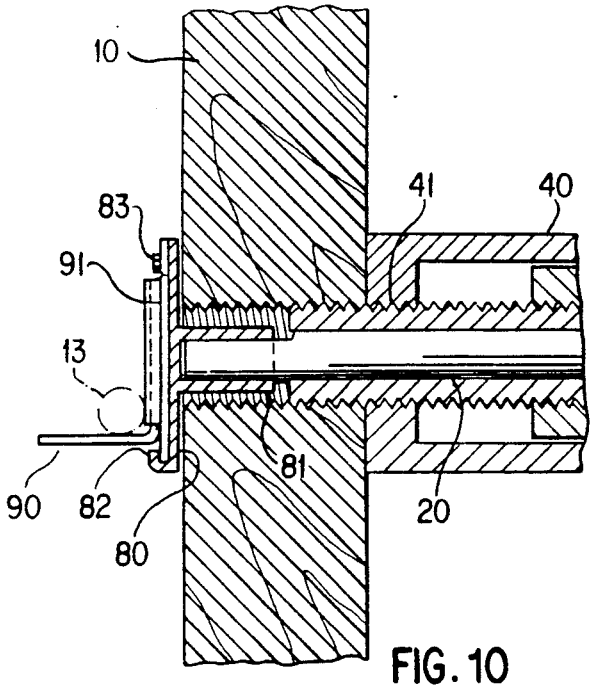
FIG. 10 is a partial cross-sectional view showing one embodiment of a mounted arrow rest according to this invention.
Figure 11:
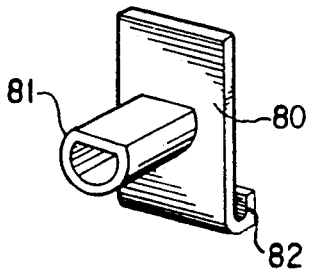
FIG. 11 is a perspective rear view of fitting means shown in FIG. 12.
Figure 12:
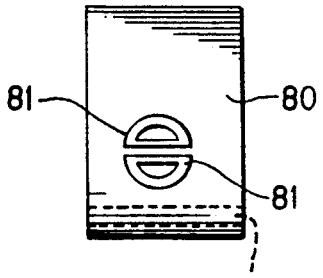
FIG. 12 is a rear view of another embodiment of the fitting means.
Figure 13:
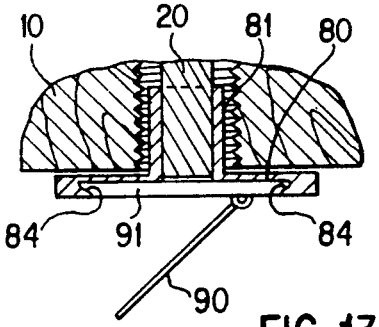
FIG. 13 is a top cross-sectional view of another embodiment of an arrow rest according to this invention.
Figure 14:
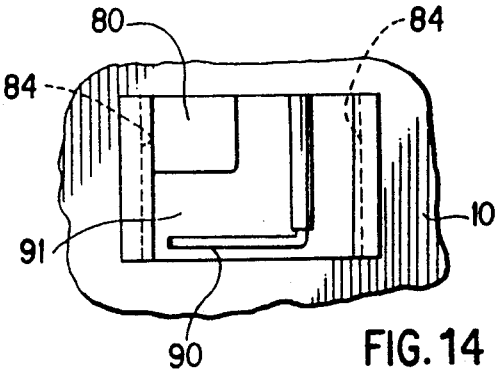
FIG. 14 is a front view of the arrow rest shown in FIG. 13.

The above-referenced patents teach a suitable mating mounting plate as shown in FIGS. 11 and 12 wherein mounting plate 80 has lip holding means 82 along the bottom edge and undercut holding means 83, as shown in FIG. 10, extending through elongated holes in flat plate 91 to hold it firmly in position. Thus, the retractable arrow rest may be readily replaced and assuredly positioned in the same position on mating mounting plate 80. Any suitable means for holding the retractable arrow rest to mounting plate 80 may be used. Another means for holding flat plate 91 is shown in FIGS. 13 and 14 wherein opposing sides have undercut edges 84 which mate with opposing sides of flat plate 91. Having a removable flat plate 91 as well as the connection between fitting means 81 and mounting means 20 provides an arrow rest having double instantly replaceable capabilities so that the arrow rest can be replaced either way.

Figure 15:
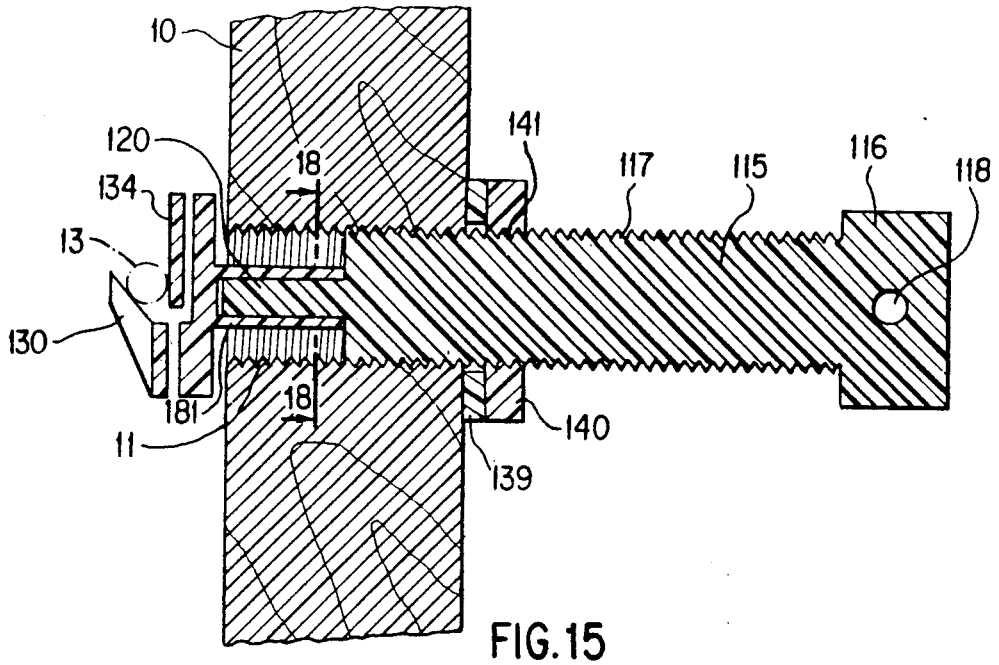
FIG. 15 is a cross-sectional view through a bow handle from the side of the archer showing one embodiment of a mounted arrow rest of this invention.

FIG. 15 shows one embodiment of a laterally adjustable one-piece arrow rest, having a movable arrow support ar 130 which deflects and automatically returns to an initial predetermined position. Adjusting screw 115 is installed within through opening 11 in handle-riser portion 10 of an archery bow. Adjusting screw 115 is secured and maintained in fixed relation to the bow by adjusting screw external threads 117 engaging internal threads of through opening 11. Adjusting screw 115 can be inserted into through opening 11 from either the arrow side or side opposite the arrow side of bow handle-riser portion 10. Adjusting screw 115 may be firmly held in a fixed lateral position by washer 139 and lock nut 140. Lock nut 140 can have internal threads 141 which engage adjusting screw external threads 117 and can be screwed tightly against one side of washer 139. The opposite side of washer 139 can be adjacent either side of bow handle-riser portion 10 of an archery bow.

Adjusting screw 115 has adjusting screw end 116 positioned away from bow handle-riser portion 10. Adjusting screw end 116 can have an outside diameter greater than the outside diameter of adjusting screw 115. However, adjusting screw 115 has the capability of being inserted from either side of bow handle-riser portion 10 only if adjusting screw end 116 has an outside diameter less than or equal to the inside diameter of the internal threads of through opening 11. Adjusting screw end 116 has diametrical through hole 118 into which a rod is inserted for at least two purposes. First, the rod can be used as a lever arm to torque adjusting screw 115 into through opening 11. Second, through hole 118 aligns with first connecting means 120 so that through hole 118 or the rod inserted within through hole 118 can be used as an index for the alignment of first connecting means 120.

Rotating adjustment screw 115 causes lateral movement of adjusting screw 115. The exterior surface of lock nut 140 may have flats for engaging a wrench or may have knurls and a diameter sufficiently sized for hand tightening. The knurls allow quick assembly and disassembly in the field, without a need for tools. When lock nut 140 is rotated tightly against washer 139 and washer 139 against bow handle-riser portion 10, both adjusting screw 115 and lock nut 140 are firmly attached in a fixed position with respect to the bow. It is preferred that threads 117 of adjustment screw 115 extend approximately halfway through the thickness of bow handle-riser portion 10 to provide sufficient support for adjustment screw 115 and to provide sufficient longitudinal bearing surface between first connecting means 120 and second connecting means 181.

In one embodiment of this invention, second connecting means 181 has an elongated shape and has a sleeve adapted to fit non-rotatably but longitudinally movable and to seat with first connecting means 120 of adjusting screw 115. The term "seat" or "seated", as used throughout this specification and in the claims, is intended to mean that the seated component is fixed in a particular position, with respect to another component. First connecting means 120 may have any suitable cross-sectional shape that non-rotatably mates with second connecting means 181. Various cross-sectional shapes for first connecting means 120 and mating second connecting means 181 may be used. First connecting means 120 according to this embodiment is shown more clearly in the cross-sectional view of FIG. 18. The non-circular cross-sectional shape of first connecting means 120 provides a non-rotatable and longitudinally movable fit and seat within second connecting means 181. First connecting means 120 may have other cross sections such as a truncated circular cross section or a splined shape cross section. It is readily apparent that other non-circular cross-sectional shapes would also be suitable.

Figure 16:
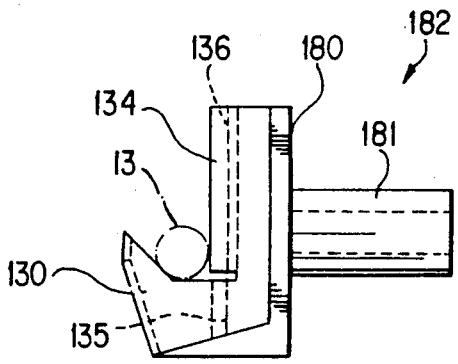
FIG. 16 is a rear view of the arrow rest as shown in FIG. 15.
Figure 17:
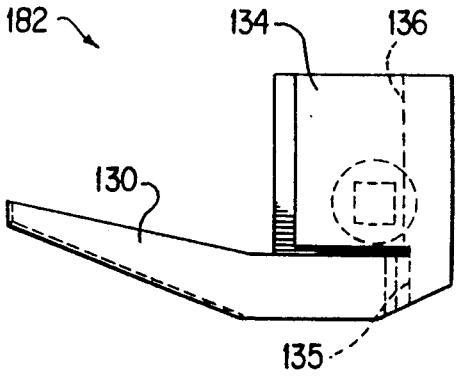
FIG. 17 is a side view of the arrow rest as shown in FIG. 15.
Figure 18:
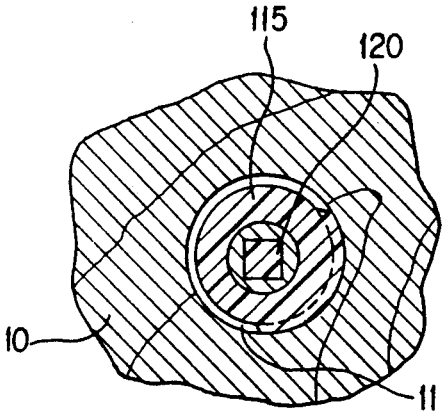
FIG. 18 is a cross-sectional view along line 18—18 in FIG. 15 showing one embodiment of first connecting means and second connecting means.

In addition to first connecting means 120 being adjustable longitudinally with respect to bow handle-riser portion 10, pressure from the arrow shaft applied laterally to arrow rest 182 may force arrow contact portion 134, as shown in FIGS. 15–17, inwardly thereby causing longitudinal movement of contact portion 134 by a resilient contact hinge which returns to its original predetermined position when the force of the arrow shaft is removed. The resilient contact hinge is formed by a section of contact portion 134 having a reduced moment of inertia, with respect to the moment of inertia of adjacent sections of contact portion 134, in order to reduce the bending resistance of contact portion 134. The grooved portion of the resilient hinge reduces the force necessary to deflect the cantilever portion of contact portion 134. The force necessary to move contact portion 134 ca be adjusted by quickly and easily replacing one arrow rest 182 with another arrow rest 182 either having a different grooved portion forming a resilient contact hinge or having different construction material.

In one preferred embodiment according to this invention, first connecting means 120 are non-rotatably mated and seated with respect to second connecting means 181. In this particular embodiment, the term "seated" is intended to mean that first connecting means 120 is fixed in a mated position with second connecting means 181. The end, facing away from the arrow shaft, of second connecting means 181 can seat against the shoulder created where the base of first connecting means 120 meets adjusting screw 115. Second connecting means 181 can also seat with respect to first connecting means 120 if the end face of first connecting means 120 contacts the plate portion of second connecting means 181, or the seating can occur if the plate portion of second connecting means 181 contacts bow handle-riser portion 10. Even if first connecting means 120 does not seat on second connecting means 181, an interference fit with friction and compression between both connecting means will hold arrow rest 182 in a fixed position with respect to first connecting means 120.

Although one preferred embodiment of this invention has two mating pieces with first connecting means 120 having the male fitting and second connecting means 181 having the female fitting, it is apparent that another embodiment of this invention may have first connecting means 120 as the female fitting and second connecting means 181 as the male fitting.

Prior arrow rests secure to bow handle-riser portion 10 with adhesives, screws, or the like, which require complete realignment once removed. In addition, except for the stick-on type, which uses double-sided tape, prior arrow rests require tools for assembly and disassembly. The non-rotatable and seating connection of this invention provides quick and easy field assembly and disassembly without a need for tools while maintaining the precise position and alignment of the arrow rest.

One important embodiment of this invention includes a pivotal arrow support arm 130 as an integral one-piece part of arrow rest 182 whereby arrow support arm 130 deflects upon an arrow shaft and fletching passing over arrow support arm 130. A grooved portion forming resilient arm hinge 135 near the base of arrow support arm 130 causes automatic return of arrow support arm 130 to its initial predetermined position after discharge of an arrow. Arrow support arm 130 extends beyond the side of the bow handle-riser portion 10 and receives arrow shaft 13, as shown in FIG. 16.

When the force of the arrow passing over arrow support arm 130 is terminated, the grooved portion forming resilient arm hinge 135 at the base of arrow support arm 130 creates a force sufficient to return arrow support arm 130 to its original predetermined position. The resilient arm hinge is formed by a section of arrow support arm 130 having a reduced moment of inertia, with respect to the moment of inertia of adjacent sections of arrow support arm 130, in order to reduce the bending resistance of arrow support arm 130. The grooved portion of the resilient hinge reduces the force necessary to deflect the cantilever portion of arrow support arm 130. Likewise, the lateral force of the arrow shaft can cause contact portion 134 to move laterally toward the bow and when the force of the arrow passing over contact portion 134 is terminated, the grooved portion forming resilient contact hinge 136 near the base of contact portion 134 creates a force sufficient to return contact portion 134 to its original predetermined position. The force, within the resilient hinges of this invention, opposing the force created by the moving arrow shaft may be controlled by varying the grooved portion or by varying the construction material used for arrow rest 182. The top of arrow support arm 130 and contact portion 134 may be covered with a low friction material that reduces the frictional drag between arrow shaft 13 and support arm 130. Suitable low friction materials include low friction plastics, such as fluorinated hydrocarbons, TEFLON TM, or any other low friction materials known to those persons skilled in the art.

This invention provides an improved arrow rest as shown in FIGS. 15–18, where arrow support arm 130, contact portion 134, mounting plate 182 and second connecting means 181 are formed from one piece. With an interference fit, second connecting means 181 and first connecting means 120 can be quickly and easily assembled, disassembled, and reassembled without a need for tools. The non-rotatable and seated mating of second connecting means 181 with first connecting means 120 allows arrow rest 182 to be precisely positioned and aligned with respect to bow handle-riser portion 10. Adjusting screw 115 and holding nut 140 allow lateral positioning and securing of arrow rest 182 with respect to bow handle-riser portion 10.

The components of the arrow rest of this invention may be constructed of suitable materials which are durable and resist weather. Suitable metals and moldable plastics will be readily apparent to one skilled in the art.

The quick disconnect means is one important aspect of this invention which allows the arrow rest to be dismounted then instantly replaced in a precise and consistent predetermined position. The quick disconnect means includes first connecting means 120 fixed with respect to handle-riser portion 10 of an archery bow and second connecting means 181 secured to the arrow rest.

It is apparent that the many elements of each of FIGS. 1–18 as described above can be interchanged to enhance the versatility of this invention. The many embodiments shown in the drawings and described in this specification require mating connections between male and female elements as well as other elements shown in the drawings and described in the specification as having a particular shape. It is also apparent that male and female roles of each element can be interchanged in such embodiments and mirror images or mirror configurations of such other elements can be used to accomplish objectives of this invention without departing from the result of obtaining an instantly replaceable arrow rest.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. An arrow rest comprising:

a housing, an arrow support arm having a riser portion and a support portion, said riser portion rotatably mounted with respect to said housing;

a return spring mounted with respect to said arrow support arm to urge said support portion into a rest position;

stop means for limiting normal movement of said support portion in a forward direction from said rest position to a deflected position, said stop means comprising a leaf spring separate from said return spring and secured with respect to said housing; and release means for allowing said support portion to deflect in a backward direction beyond said rest position of said normal movement and for allowing said support portion to be reset to said rest position.

2. An arrow rest according to claim 1 further comprising a bushing secured to said housing, said bushing having a through bore, said riser portion mounted within said through bore, and said riser portion having limited vertical movement.

3. An arrow rest according to claim 1 wherein said leaf spring has a detent portion stopping said support portion at said rest position.

4. An arrow rest according to claim 1 wherein said stop means further comprises a housing wall of said housing positioned to stop said support portion at a terminal point of said deflected position.

5. An arrow rest according to claim 1 wherein said return spring is a coil spring mounted around said riser portion.

6. An arrow rest according to claim 5 wherein said coil spring comprises two opposing spring feet, one of said spring feet being attached to a free end portion of said riser portion, and another of said spring feet abutting a housing wall of said housing.

7. An arrow rest according to claim 1 further comprising a cover secured to said housing.

8. An arrow rest according to claim 7 wherein said cover further comprises horizontal cushion means for allowing a discharged arrow to force a contact portion of said cover in a horizontal direction, with respect to a vertically positioned archery bow.

9. An arrow rest according to claim 8 wherein said horizontal cushion means further comprises said contact portion spaced from an outer wall of said housing, said contact portion mounted to said housing and said contact portion biased into a shooting position.

10. An arrow rest according to claim 8 wherein said contact portion forms an integral piece with said housing.

11. An arrow rest comprising:

a housing, an arrow support arm having a riser portion and a support portion, said riser portion rotatably mounted with respect to said housing and said support arm having a free end portion bent at an angle with respect to said riser portion;

a return spring mounted with respect to said arrow support arm to urge said support portion into a rest position;

stop means separate from said return spring for limiting normal movement of said support portion in a forward direction from said rest position to a deflected position, said free end portion of said support arm contacting stop means; and release means for allowing said support portion to deflect in a backward direction beyond said rest position of said normal movement and for allowing said support portion to be reset to said rest position.

12. An arrow rest according to claim 11 wherein said stop means further comprises a leaf spring secured to said housing and said free end portion contacting said leaf spring at said rest position.

13. An arrow rest comprising:

a housing, an arrow support arm having a riser portion and a support portion, said riser portion rotatably mounted with respect to said housing;

a return spring mounted with respect to said arrow support arm to urge said support portion into a rest position;

stop means for limiting normal movement of said support portion in a forward direction from said rest position to a deflected position, said stop means comprising a leaf spring separate from said return spring, said housing forming a groove, and said leaf spring mounted within said groove; and release means for allowing said support portion to deflect in a backward direction beyond said rest position of said normal movement and for allowing said support portion to be reset to said rest position.

* * * * *